US007111369B2

(12) United States Patent
Ho

(10) Patent No.: US 7,111,369 B2
(45) Date of Patent: Sep. 26, 2006

(54) SPRING CLIP

(75) Inventor: Yuen Choi Ho, Kwai Chung (HK)

(73) Assignee: Yik Cheong Metal Products Fty. Ltd., N.T. (HK)

( * ) Notice: Subject to any disclaimer, the term of this patent is extended or adjusted under 35 U.S.C. 154(b) by 143 days.

(21) Appl. No.: 10/928,264

(22) Filed: Aug. 30, 2004

(65) Prior Publication Data

US 2006/0042055 A1 Mar. 2, 2006

(51) Int. Cl.
*A41F 1/00* (2006.01)
*A44B 17/00* (2006.01)

(52) U.S. Cl. ..... 24/668; 24/666

(58) Field of Classification Search ..... 24/668, 24/666

See application file for complete search history.

(56) References Cited

U.S. PATENT DOCUMENTS 1,346,911 A * 7/1920 Peterson ..... 24/668
1,775,101 A * 9/1930 Hodge ..... 24/668
1,792,289 A * 2/1931 Domkee ..... 24/668
1,820,450 A * 8/1931 Fenton ..... 24/668
1,824,547 A * 9/1931 Hodge ..... 24/668
1,844,283 A * 2/1932 Hodge ..... 24/668
2,146,496 A * 2/1939 Anderson ..... 24/668
5,005,269 A 4/1991 Hirsch
5,706,561 A 1/1998 Kipperman
6,226,845 B1 * 5/2001 Fink ..... 24/668

* cited by examiner

*Primary Examiner*—Robert J. Sandy
(74) *Attorney, Agent, or Firm*—Rabin & Berdo, P.C.

(57) ABSTRACT

The present invention discloses a spring clip for clothes. The spring clip includes a gourd-like wire loop with two free ends and a encasement for movably holding the free ends. The encasement is composed of a first member and a second member assembled together and symmetric to each other. The free ends are received and held in a chamber defined between said first member and second member. The first member has pins for presenting said free ends from escaping from the chamber. The second member has apertures corresponding to the pins. The pins are respectively secured in the apertures by means of riveting.

11 Claims, 2 Drawing Sheets

SPRING CLIP

BACKGROUND OF THE INVENTION

1. Field of the Invention

The present invention relates to a resilient device for garments, and more particularly to an improved spring clip for engaging buttons on shoulders straps on overalls.

2. Description of Related Art

In clothing industry, various fastening devices are being used in garments, jeans, overalls, and mostly used in suspenders.

In general, the resilient device is a button loop engaging the button project from the suspender. The resilient device can fasten or released from the button which freely dressing or removing the suspenders. The convenience of using should be one of the features for the subject product. In order to satisfy increasing requirement from the users, the subject product have been continuously improved. Currently, two conventional spring clips have been disclosed in published patent specification.

The first conventional spring clip is disclosed in the U.S. Pat. No. 5,005,269, invented by Nathan A. Hirsch. With reference to FIG. 1, this spring clip is substantially composed of a gourd-like wire loop and an encasement to hold two free ends of the wire loop. The wire loop includes a horizontal portion 14 and two opposed bowed leg portions 16, 18. The encasement includes an integrally formed saddle member 70 being composed of a pair of flat opposed side walls. Two holes 84, 86 are defined at two ends of the encasement, and the two free ends of the wire loop are respectively positioned in the holes 84, 86. The free ends abut together in the holes 84, 86 in a closed status without an external force, and will be depart from each other in an open status with an external force is applied. The free ends of the wire loop are allowed to move in the encasement and altered in the closed and open statuses. Because the encasement is an integrally formed structure made by means of punching, it is possible to deform the encasement under an overload if a wearer is large or fat too much, and thus the free ends will be detached from the deformed encasement.

The second conventional spring clip is disclosed in the U.S. Pat. No. 5,706,561, invented by Ronald Kipperman. With reference to FIG. 2, this spring clip also includes a gourd-like wire loop. In the first conventional spring clip, the two free ends are at a top of the gourd-like wire loop. On the contrary, the second conventional spring clip has two hook-like free ends 19, 20 at a bottom of the wire loop, e.g. the horizontal portion. The hook-like free ends 19, 20 are interlocked each other to enable the horizontal portion to move, so a width between two bowed sections 13, 14 is adjustable to allow a stem 5 of a button to pass through an entry point defined by the bowed sections 13, 14 and rest in a button receiving portion 12. The button receiving portion 12 adjacent the bowed sections 13, 14 is closed, the horizontal portion is away from the bowed sections 13, 14, and a movable range of the hook-like ends 19, 20 is small. Therefore, an adjustable range of the bowed sections 13, 14 is limited to result an inconvenient movement of the stem 5.

SUMMARY OF THE INVENTION

A main object of the present invention is to provide a spring clip with good elasticity and strength to mitigate the aforementioned problems.

According to the invention, a spring clip comprising:

a gourd-like wire loop with two free ends; and a encasement for movably holding the free ends, the encasement being composed of a first member and a second member assembled together and symmetric to each other, and the free ends received and held in a chamber defined between the first member and second member.

The first member has a first pin and second pin substantially perpendicular to a body of the first member for respectively presenting the free ends from escaping from the chamber, and the second member has a first aperture and second aperture corresponding to the pins.

The first member further has at least one pin between the first and second pins, and the second member further has at least one aperture corresponding to the at least one pin.

The pins are respectively secured in the apertures by means of riveting.

The first member and second member each have two edges formed at two opposed sides and substantially perpendicular to the bodies thereof.

The encasement has a fan-like or quadrangular shape.

The encasement is made of metal or alloy, preferably zinc alloy.

The encasement is made of rigid plastic such as acetal resin or nylon plastic.

Therefore, the improved structure of the spring clip provides a good elasticity for a neck to hold a button and a durable encasement.

Other objects and advantages of the invention will become more apparent from the following detailed description when taken in conjunction with the accompanying drawings.

DETAILED DESCRIPTION OF THE PREFERRED EMBODIMENT

Figure 1:
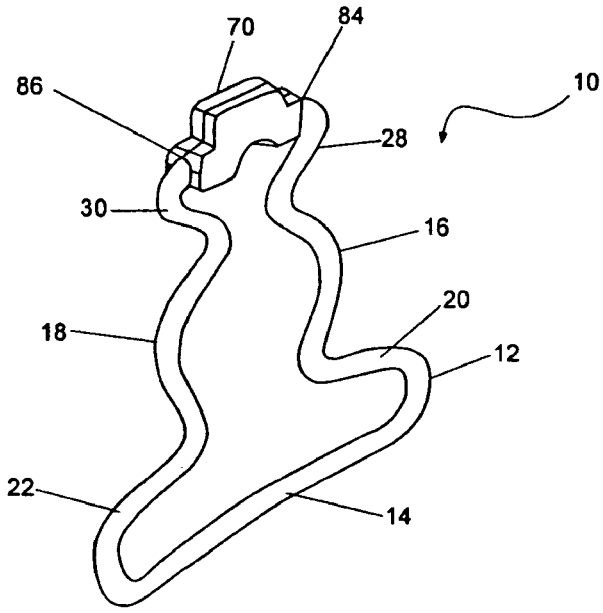
Fig 1 PRIOR ART
FIG. 1 is a perspective view of a conventional spring clip.
Figure 2:
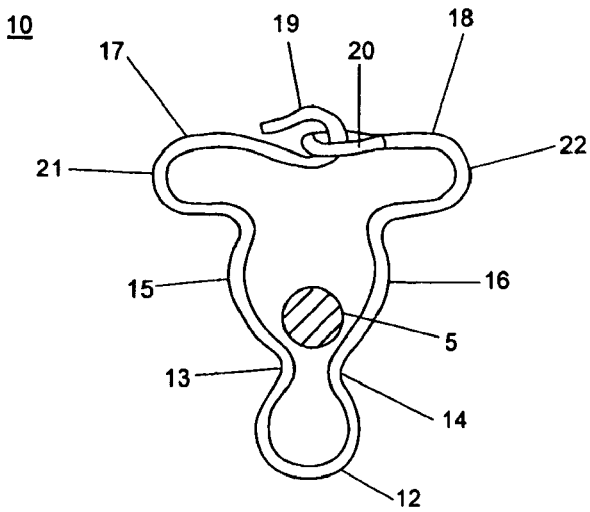
Fig 2 PRIOR ART
FIG. 2 is a schematic view of another conventional spring clip.
Figure 3:
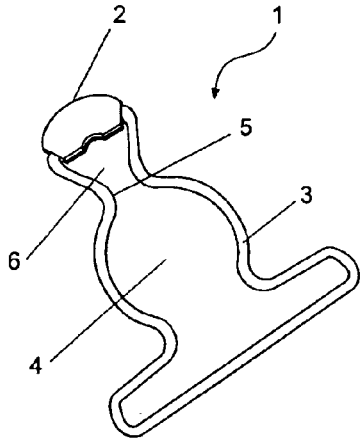
FIG. 3 is a perspective view of a spring clip in accordance with the present invention.

With reference to FIG. 3, a spring clip in accordance with the present invention is composed of a wire loop 3 and an encasement 2. The wire loop 3, made of a metal wire, has a gourd-like shape with two S-like free ends. The wire loop 3 includes a button receiving portion 4, a neck portion 5, and a button holding portion 6. The encasement 2 is made of a metal material such as zinc alloy, copper alloy etc. and preferably zinc alloy which is low-cost, strong, durable and can be color plated. Of course, the encasement 2 and wire loop 3 can be made of other material such as rigid plastic like acetal resin (POM) or Nylon plastic (PA6) by means of injection molding.

Figure 4:
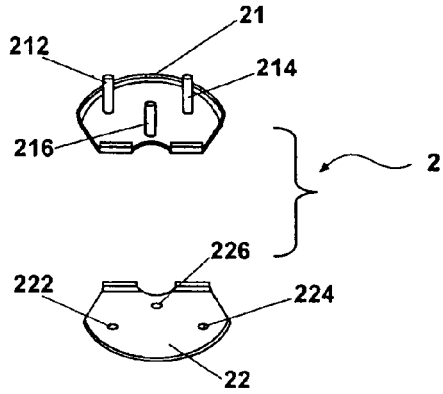
FIG. 4 is an exploded perspective view of an encasement of the spring clip in FIG. 3
Figure 5:
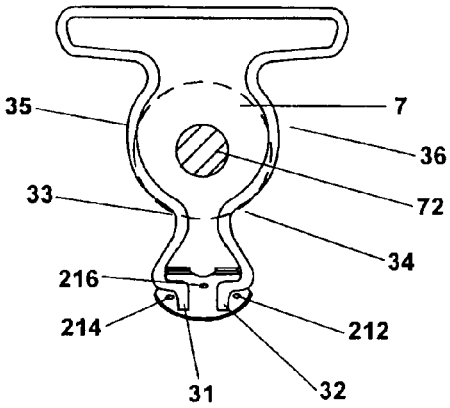
FIG. 5 is a schematic view of the spring clip for fastening a button.

With reference to FIGS. 4 and 5, the encasement 2 is composed of a first member 21 and a second member 22 assembled together and substantially symmetric to each other. The first member 21 and second member 22 each have two edges (not numbered) respectively formed at two opposed sides thereof and substantially perpendicular to a body thereof. The edges and bodies of the first and second members 21, 22 define a chamber to receive the free ends 31, 32 of the wire loop 3.

The first member 21 is provided with a first pin 212 and a second pin 214 to prevent the free ends 31, 32 of the wire loop 3 from escaping from the encasement. In this embodiment, the first member 21 is further provided with an additional pin 216. The first and second pins 212, 214 are respectively formed at two open ends of the first member 21, and the additional pin 216 is formed between the first and second pins 212, 214. Preferably, the three pins 212, 214, 216 constitute a triangle, of which the vertex is the additional pin 216 so as to position the free ends 31, 32 respectively in two bevel edges of the triangle. Namely, the first free end 31 is limited by the first pin 212 and additional pin 216, and the second free end 32 is limited by the second pin 214 and additional pin 216. As illustrated in FIG. 5, the free ends 31, 32 are movable in limited ranges defined by the pins 212, 214, 216.

Three apertures 222, 224, 226 are defined in the second member 22 and corresponding to the pins 212, 214, 216, as shown in FIG. 4. In procedure of assembling the encasement 2, the first and second members 21, 22 receiving the free ends 31, 32 of the wire loop 3 are punched to rivet the pins 212, 214, 216 into the apertures 222, 224, 226.

According to the present invention, the quantity of the pins or apertures can be two or more than three, for example four, which is adapted to fasten and limit the free ends 31, 32 of the wire loop.

The button receiving portion 4 is defined by two outward bowed portions 35, 36 for receiving a button 7 therein. The neck 5 adjacent the button receiving portion 4 is defined by two inward bowed portions 33, 34 between which a narrowest width is smaller than an outer diameter of a stem 72 of the button 7.

In use, when the button 7 passes through the neck 5 to enter into or escape from the inward bowed portions 33, 34, the free ends 31, 32 are forced to move outwards. Therefore, the inward bowed portions 33, 34 are expanded outwards, and the width of the neck 5 are enlarged to allow the stem 72 to pass through the neck 5.

These elements of the encasement 2 can be made of zinc alloy by means of die-casting. Alternatively, if the encasement is made of rigid plastic, a common injection molding method can be used. The encasement 2 can be made with various shapes such as fan-like, quadrangular, or polygonal etc.

The spring clip made of zinc alloy can be color plated to provide an attractive appearance.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A spring clip for clothes, comprising:

a gourd-like wire loop with two free ends; and a encasement for movably holding the free ends, said encasement being composed of a first member and a second member assembled together and symmetric to each other to define a chamber therebetween, said free ends being received and held in the chamber, wherein said first member has a first pin and second pin substantially perpendicular to a body of said first member for respectively preventing said free ends from escaping from said chamber, and said second member has a first aperture and second aperture corresponding to the pins.

2. The spring clip as claimed in claim 1, wherein said first member further has at least one pin between said first and second pins, and said second member further has at least one aperture corresponding to the at least one pin.

3. The spring clip as claimed in claim 2, wherein said pins are respectively secured in said apertures by riveting.

4. The spring clip as claimed in claim 3, wherein said encasement has a fan-like shape.

5. The spring clip as claimed in claim 3, wherein said encasement has a quadrangular shape.

6. The spring clip as claimed in claim 5, where in said encasement is made of zinc alloy.

7. The spring clip as claimed in claim 1, wherein said pins are respectively secured in said apertures by riveting.

8. The spring clip as claimed in claim 1, wherein said first member and second member each have two edges formed at two opposed sides and which are substantially perpendicular to the bodies thereof.

9. The spring clip as claimed in claim 1, wherein said encasement is made of metal or alloy.

10. The spring clip as claimed in claim 1, wherein said encasement is made of acetal resin or nylon plastic.

11. The spring clip as claimed in claim 1, wherein said encasement is made of rigid plastic.

* * * * *